US006871860B1

(12) United States Patent
Esse ya

(10) Patent No.: US 6,871,860 B1
(45) Date of Patent: Mar. 29, 2005

(54) IN-LINE PIVOTING WHEEL ROLLER SKATES WITH SHOCK ABSORBERS

(76) Inventor: Constant Noel Esse ya, 179 Sheridan 2nd Fl, Paterson, NJ (US) 07502

( * ) Notice: Subject to any disclaimer, the term of this patent is extended or adjusted under 35 U.S.C. 154(b) by 137 days.

(21) Appl. No.: 10/174,313

(22) Filed: Jun. 17, 2002

(51) Int. Cl.[7] ..... A63C 17/04

(52) U.S. Cl. ..... 280/11.231; 280/11.224; 280/11.27

(58) Field of Search ..... 280/11.224, 11.225, 280/11.221, 11.223, 11.231, 11.27, 11.28, 11.14, 11.15, 11.19, 11.3, 11.31, 11.32, 11.33, 11.34, 842, 615; 36/115

(56) References Cited

U.S. PATENT DOCUMENTS

| | | | | | |
|---|---|---|---|---|---|
| 584,089 | A | * | 6/1897 | Buttermilch | 280/11.233 |
| 628,433 | A | * | 7/1899 | Finch | 280/7.13 |
| 1,632,997 | A | * | 6/1927 | Connolly | 280/11.19 |
| 4,061,348 | A | * | 12/1977 | Carter | 280/11.201 |
| 5,331,752 | A | * | 7/1994 | Johnson et al. | 36/115 |
| 5,405,156 | A | * | 4/1995 | Gonella | 280/11.28 |
| 5,408,763 | A | * | 4/1995 | Sartor et al. | 36/115 |
| 5,491,991 | A | * | 2/1996 | Chen | 36/89 |
| 5,503,413 | A | * | 4/1996 | Belogour | 280/11.225 |
| 5,551,712 | A | * | 9/1996 | Repucci | 280/11.205 |
| 5,586,774 | A | * | 12/1996 | Dentale | 280/11.225 |
| 5,979,916 | A | * | 11/1999 | Gatel et al. | 280/11.224 |
| 6,056,299 | A | * | 5/2000 | Soo | 280/11.27 |
| 6,557,864 | B1 | * | 5/2003 | Lenoir | 280/11.221 |

FOREIGN PATENT DOCUMENTS

| | | | |
|---|---|---|---|
| CH | 81627 | * | 7/1919 |
| DE | 191872 | * | 1/1907 |
| GB | 2744 | * | 7/1876 |
| GB | 11727 | * | 5/1909 |
| GB | 20480 | * | 9/1910 |
| JP | 4-8332 | * | 1/1992 |

* cited by examiner

*Primary Examiner*—Bryan Fischmann

(57) ABSTRACT

An in-line skate composed of an inner boot connected to an outer boot at a pivot point near the toe. Mounted between the inner and outer boots springs under the heel area, used to limit and dampen the shock and vibration transmitted to the skater. The inner and outer boots contain mating holes in the upper heel area, for the engagement of a locking pin. Freeing the boot sections decompresses the springs and allows them to function as shock absorbers. The locking pin has an enlarged end that is sized to move freely in the inner boot portion of the hole yet be retained by the smaller stop portion defined by the outer boot mating hole. The wheel frame has a section for the retention of the majority of the wheels, and a section for the retention of a pivoting wheel. The pivoting wheel frame contains internally lubricated ball bearings for ease of movement while pivoting.

9 Claims, 4 Drawing Sheets

IN-LINE PIVOTING WHEEL ROLLER SKATES WITH SHOCK ABSORBERS

BACKGROUND OF THE INVENTION

1. Field of the Invention

The present invention relates generally to roller skates, and more particularly to in-line pivoting wheel roller skates with shock absorbers for use in connection with in-line roller skating. The in-line pivoting wheel roller skates with shock absorbers have particular utility in connection with extreme or trick skating, as is done in skate parks. The in-line pivoting wheel roller skates with shock absorbers also have utility in connection with skaters who are trying to achieve the same type of movement that can be accomplished with ice skates.

2. Description of the Prior Art

Roller skating, and particularly in-line roller skating, has become extremely popular in recent years. In-line skates generally have a rigid frame and skate boot attached to the frame. In-line skates also typically feature a plurality of wheels mounted to a common frame. The frame carries the axles of the wheels, which are mounted in parallel spaced-apart alignment.

In-line pivoting wheel roller skates with shock absorbers are desirable use in extreme or trick skating, as the shock absorption provided by the present invention helps dampen the shock to the skater caused by the leaps common to the endeavor. The skates are also of use to people whom ice skate and need an efficient and cost-effective way to practice when access to an ice rink is difficult. The swiveling wheel allows the in-line skate to replicate moves that were heretofore only available to ice skates, as prior art in-line roller skates did not include the lessening of friction inherent in the present design.

The use of suspension systems is known in the prior art. For example, U.S. Pat. No. 5,503,413 to Belogour discloses a suspension system mounted between the heel of the skate boot and the wheel frame. However, the Belogour '413 patent does not have the ability to engage additional shock absorption as disclosed in the present invention, and has further drawbacks of only providing one spring for shock absorption.

U.S. Pat. No. 6,102,412 to Staffaroni discloses a skate with molded boot that provides vibration dampening and shock absorption, thereby helping to decrease the fatigue and discomfort to the skater. However, the Staffaroni '412 patent does not provide the ability to engage additional shock absorption as needed, as disclosed in the present invention, and additionally does not provide the same structural elements as the present invention.

Also, U.S. Pat. No. 5,527,048 to Conte discloses a braking mechanism that can be used with in-line roller skates. However, the Conte '048 patent does not disclose a shock absorption system, and additionally does not provide for the pivoting rear wheel of the present invention.

Similarly, U.S. Pat. No. 6,053,512 to Chang discloses a suspension system for in-line roller skates that can be attached to an in-line roller skate boot. However, the Chang '512 patent does not provide the vibration dampening gained by the inner and outer boot system of the present invention, and can not provide the shock absorption provided by the multiple springs used in the present invention.

Additionally, U.S. Pat. No. Des. 347,672 to Arney et al. discloses an in-line roller skate that has clasps and multiple wheels. However, the Arney '672 patent does not contain a shock absorption mechanism, and has the additional deficiency of not providing the freedom of movement disclosed by the pivoting rear wheel of the present invention.

Lastly, U.S. Pat. No. 4,132,425 to Lehner et al., discloses multi-wheel in-line roller skates that have a rotating rear wheel. However, the Lehner '425 patent does not provide the stability inherent in the present invention, as the skate boot attaches to a two piece flexible frame in the Lehner '425 patent. Additionally the Lehner '425 patent does not provide the vibration and shock absorption of the present invention.

While the above-described devices fulfill their respective, particular objectives and requirements, the aforementioned patents do not describe a in-line pivoting wheel roller skates with disengageable shock absorbers that allows for the addition of additional shock absorption as the skater deems necessary. The prior art also makes no provision for the enhanced movement made possible by the present invention. The Belogour '413 patent makes no provision for guiding the boot relative to the base to limit the lateral movement that can be generated during skating. Limiting this movement adds to the safety of the skater. The Chang '512 patent does not provide the vibration dampening gained by the inner and outer boot system of the present invention. This additional dampening, in addition to the use of multiple springs, helps to lessen the fatigue the skater feels.

Therefore, a need exists for a new and improved in-line pivoting wheel roller skates with shock absorbers that can be used for extreme skating as well as conventional in-line skating. In this regard, the present invention substantially fulfills this need. In this respect, the in-line pivoting wheel roller skates with shock absorbers according to the present invention substantially departs from the conventional concepts and designs of the prior art, and in doing so provides an apparatus primarily developed for the purpose of enhancing the enjoyment and safety of the sport, as well as opening new opportunities for the skates as training tools.

SUMMARY OF THE INVENTION

In view of the foregoing disadvantages inherent in the known types of roller skates now present in the prior art, the present invention provides an improved in-line pivoting wheel roller skates with shock absorbers, and overcomes the above-mentioned disadvantages and drawbacks of the prior art. As such, the general purpose of the present invention, which will be described subsequently in greater detail, is to provide a new and improved in-line pivoting wheel roller skates with shock absorbers which has all the advantages of the prior art mentioned heretofore and many novel features that result in a in-line pivoting wheel roller skates with shock absorbers which is not anticipated, rendered obvious, suggested, or even implied by the prior art, either alone or in any combination thereof.

To attain this, the present invention essentially comprises an in-line skate composed of inner and outer boot parts where the skater places their foot into the inner boot portion. The inner boot is connected to the outer boot at a pivot point near the toe. Mounted between the inner and outer boots are at least two springs under the heel area, used to limit and dampen the shock and vibration transmitted to the skater. The inner and outer boots contain mating holes in the upper heel area, for the engagement of a locking pin to alternately connect and disconnect the inner and outer boot sections.

Freeing the boot sections decompresses the springs and allows them to function as shock absorbers. The outer boot is mounted to a wheel frame for retaining the skate wheels. The wheel frame is a single frame that contacts the outer boot along the entire shared length.

The locking pin contains a spring-loaded retention mechanism with two connected, spring-loaded restrained balls for connecting the inner boot and outer boots and holding them in place as a single unit when engaged. The balls fit within channels in the upper area of the mating holes, and are held in place by the upward pressure of the springs of the mechanism. When the mechanism is released from the inner boot mating hole to allow the shock absorbers to function, the outer ball is outside the outer boot channel and the inner ball occupies the channel occupied by the outer ball when the boots are compressed and the shock absorbers deactivated. The locking pin has an enlarged end that is sized to move freely in the inner boot portion of the hole yet be retained by the smaller stop portion defined by the outer boot mating hole. This stop portion is designed to limit the release of the pin, so that the pin cannot be entirely disengaged from the skate boot and thus potentially be lost. The region of the outer boot where the mating hole is located is further reinforced for further strengthening of the area.

The wheel frame has a stationary section for the retention of the majority of the wheels, and a pivoting wheel section for the retention of the pivoting wheel. The pivoting wheel frame contains a plurality of internally lubricated ball bearings. The pivoting wheel frame contains horizontally aligned ports for the addition of lubrication to a lubrication chamber. These ports are closed by screws. The lubrication chamber supplies a reservoir of lubricant to the primary and secondary ball bearings. The ball bearings contact the rotation axle. The rotation axle is held in place by a hook. The hook serves to retain the rotation axle and the lubricant in the lubrication chamber. A supporting structural member exists that links the stationary and pivoting sections of the skate frame, and provides additional bracing to the pivoting wheel frame.

There has thus been outlined, rather broadly, the more important features of the invention in order that the detailed description thereof that follows may be better understood and in order that the present contribution to the art may be better appreciated.

The invention may include the pivoting wheel section at the rear of the skate frame. In this embodiment, the front section of the wheel frame would function as the stationary section for the retention of the majority of the wheels, and a rear section would function for the retention of the pivoting wheel.

The invention may also include the pivoting wheel at the front of the skate frame. In this embodiment, the rear section of the wheel frame would function as the stationary section for the retention of the majority of the wheels, and a front section would function for the retention of the pivoting wheel. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved in-line pivoting wheel roller skates with shock absorbers that has all of the advantages of the prior art roller skates and none of the disadvantages.

It is another object of the present invention to provide a new and improved in-line pivoting wheel roller skates with shock absorbers that may be easily and efficiently manufactured and marketed.

An even further object of the present invention is to provide a new and improved in-line pivoting wheel roller skates with shock absorbers that has a low cost of manufacture with regard to both materials and labor, and which accordingly is then susceptible of low prices of sale to the consuming public, thereby making such in-line pivoting wheel roller skates with shock absorbers economically available to the buying public.

Still another object of the present invention is to provide a new in-line pivoting wheel roller skates with shock absorbers that provides in the apparatuses and methods of the prior art some of the advantages thereof, while simultaneously overcoming some of the disadvantages normally associated therewith.

Even still another object of the present invention is to provide an in-line pivoting wheel roller skates with shock absorbers for simulation of moves possible heretofore only using ice skates upon ice. This allows the practice of ice skating moves on a wide variety of surfaces and environments. The ice skater can practice outside in the summer at a park instead of inside an ice rink. This will allow more people to learn and practice ice skating moves and techniques. The ball bearings of the pivoting wheel frame are provided with internal lubrication. This, along with the ability to add additional lubrication as needed, will prolong the freedom of movement of the pivoting wheel. The lubrication addition ports are horizontally aligned and closed from dirt and contamination by screws.

Still yet, another object of the present invention is to provide in-line pivoting wheel roller skates with shock absorbers for dampening the shock felt upon landing from a jump. This makes it possible to practice jumps and safely land without jarring or painful impact when the skates contact an uneven surface.

Lastly, it is an object of the present invention to provide new and improved in-line pivoting wheel roller skates with shock absorbers for allowing the shock absorption to be engaged and disengaged by the skater. This allows the skater to control the firmness of the ride dependant on the surface being traversed.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
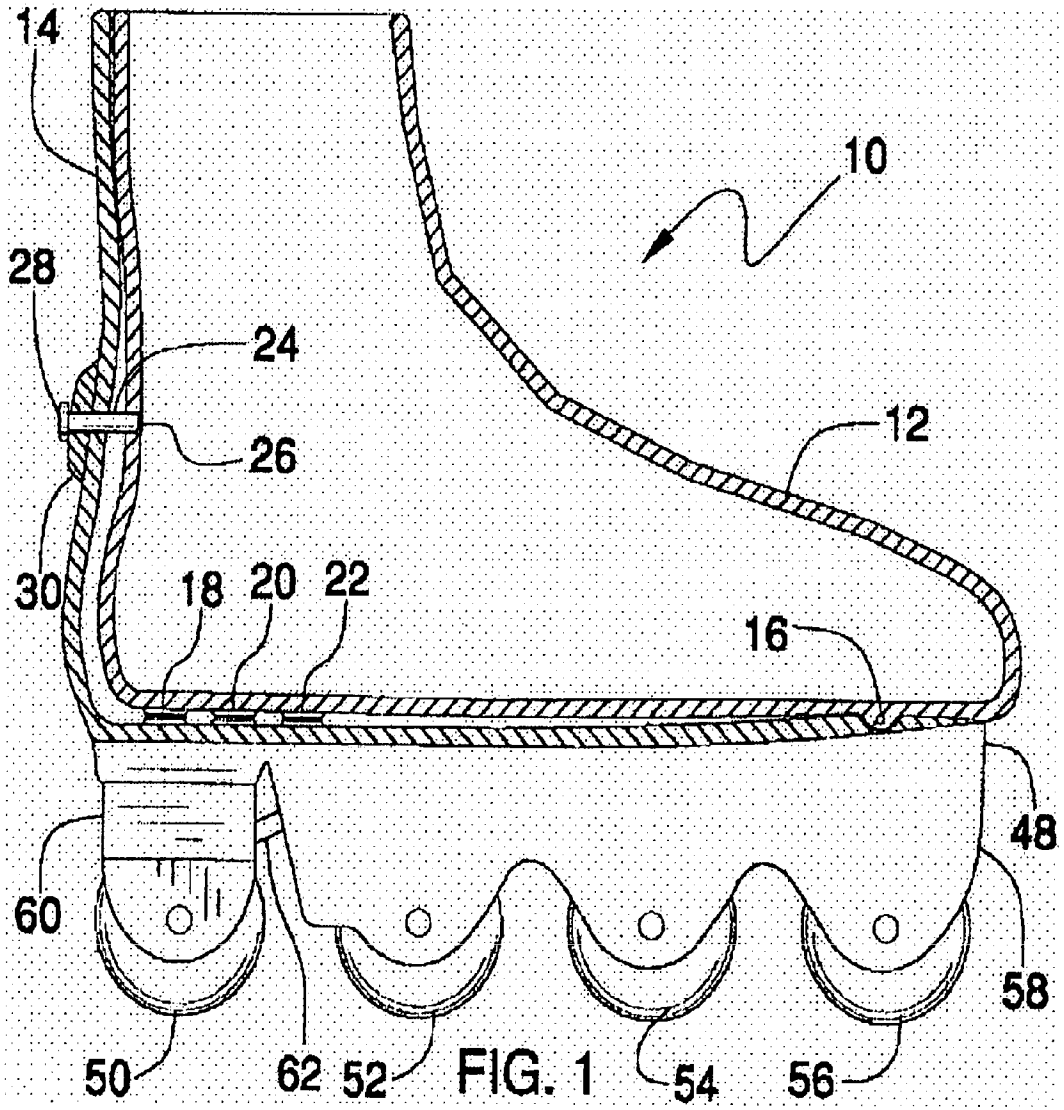
FIG. 1 is a cross-sectional view of the preferred embodiment of the in-line pivoting wheel roller skates with shock absorbers constructed in accordance with the principles of the present invention, showing the shock absorbers in the compressed state and the locking pin in the engaged state.
Figure 2:
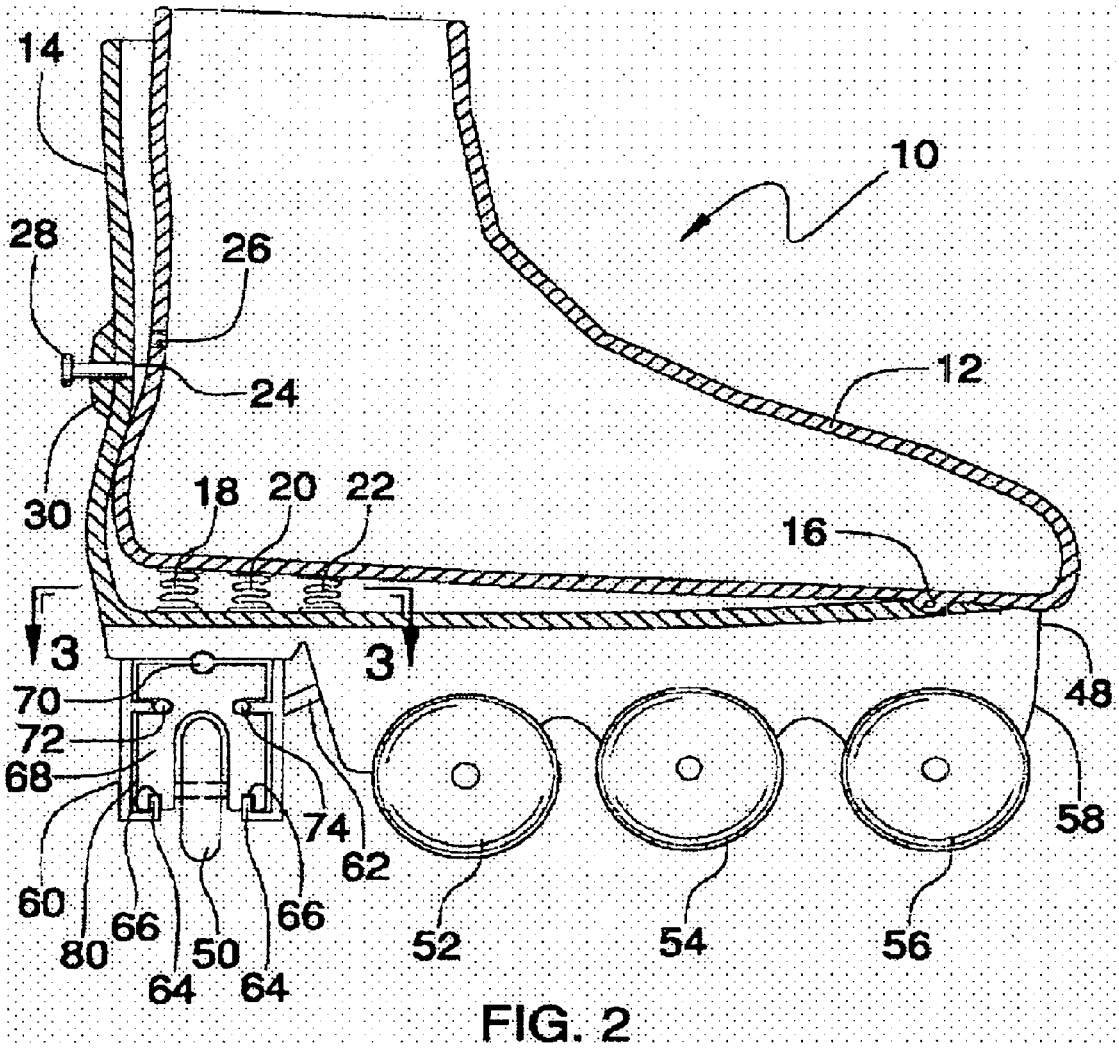
FIG. 2 is a cross-sectional view of the in-line pivoting wheel roller skates with shock absorbers of the present invention, showing the shock absorbers in the uncompressed state and the locking pin in the disengaged state, and showing the rear wheel pivoted.

Referring now to the drawings, and particularly to FIGS. 1–2, a preferred embodiment of the in-line pivoting wheel roller skates with shock absorbers of the present invention is shown and generally designated by the reference numeral 10.

In FIG. 1, a new and improved in-line pivoting wheel roller skates with shock absorbers 10 of the present invention for ease and comfort while skating is illustrated and will be described. More particularly, the in-line pivoting wheel roller skates with shock absorbers 10 has a inner boot 12 mounted atop an outer boot 14 at a pivot point 16. Mounted between the inner boot 12 and the outer boot 14 are springs 18, 20, and 22. The inner boot 12 and outer boot 14 contain mating holes 24 and 26 in the upper heel area, for the engagement of a locking pin 28. The strengthened portion 30 of the outer boot 14 is shown. The outer boot 14 is mounted to a wheel frame 48 for retaining the skate wheels 50, 52, 54 and 56. The plurality of wheels 50, 52, 54 and 56 are rotatably secured to the frame 48 about individual axes and substantially aligned in a common plane of rotation. The truck, or wheel-containing structure, comprises a wheel frame and wheels. The wheel frame 48 is a single frame that contacts the outer boot 14 along the entire shared length. The wheel frame 48 is separated into a stationary section 58 and a pivoting section 60. The sections are connected by a brace 62. The stationary section 58 holds the plurality of wheels 52, 54, and 56. The pivoting section 60 holds the wheel 50.

In FIG. 2, the locking pin 28 is shown in the disengaged and retracted mode. The locking pin 28 is free of the mating hole 24 of the inner boot 12. The locking pin 28 is still retained in the mating hole 26 of the outer boot 14. The inner boot 12 and the outer boot 14 pivot at the pivot point 16. The springs 18, 20, and 22 are decompressed to function as shock absorbers as the inner boot 12 and the outer boot 14 pivot at the pivot point 16, thereby compressing the springs 18, 20, and 22. The pivoting section 60 of the wheel frame 48 is shown with the wheel 50 turned. The ball bearings 70, 72, and 74 are shown guiding the rotation of the pivoting wheel axle 68. The hook 64 is shown in the slot 66. The brace 62 between the stationary section 58 and the pivoting section 60 of the wheel frame 48 is shown. The lubrication addition ports 76 and 78 and the lubrication chamber 80 are better shown in FIG. 4 and will be discussed with reference thereto.

Figure 3:
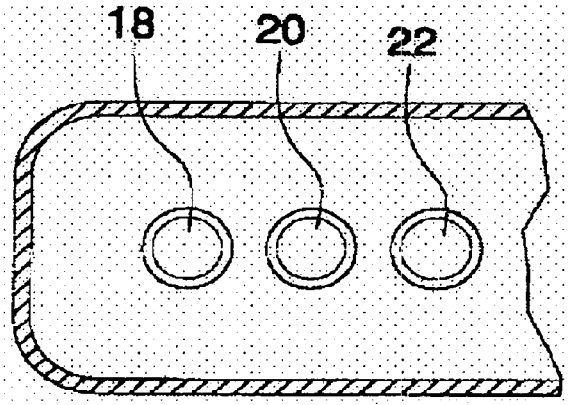
FIG. 3 is a cross-sectional view of the in-line pivoting wheel roller skates with shock absorbers of the present invention, taken substantially along the line 3—3 of FIG. 1.

In FIG. 3, the springs 18, 20, and 22 are shown in reference to their location between inner boot 12 and the outer boot 14.

Figure 4:
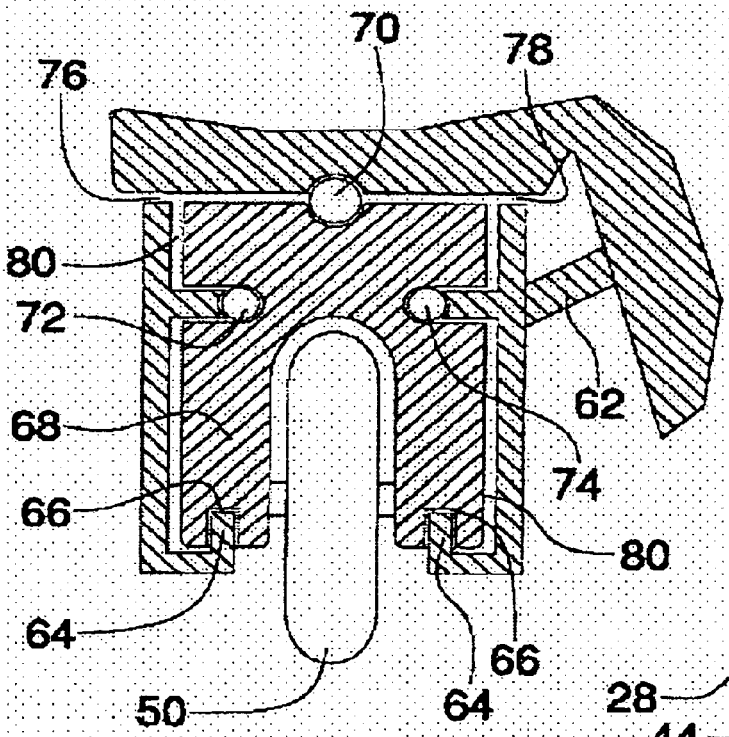
FIG. 4 is a cross-sectional view of the pivoting wheel of the in-line pivoting wheel roller skates with shock absorbers of the present invention.

In FIG. 4, the pivoting wheel 50 of the pivoting section 60 of the wheel frame 48 is shown. The ball bearings 70, 72, and 74 are shown guiding the rotation of the pivoting wheel axle 68. The brace 62 between the stationary section 58 and the pivoting section 60 of the wheel frame 48 is shown. The lubrication addition ports 76 and 78 are shown leading to the lubrication chamber 80. The lubricant added through the lubrication addition ports 76 and 78 and placed into to the lubrication chamber 80 lubricates the ball bearings 70, 72, and 74. The hook 64 slides in the slot 66 of the pivoting wheel axle 68 and functions to retain the pivoting wheel axle 68 and the lubricant in the lubrication chamber 80.

Figure 5:
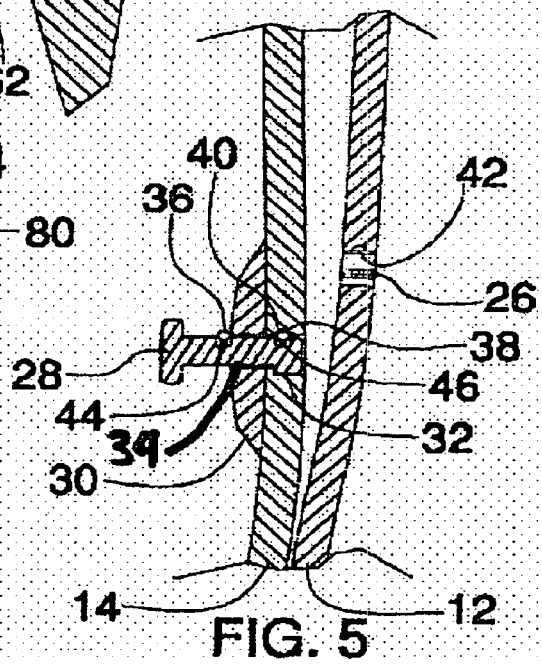
FIG. 5 is a cross-sectional detail view of the locking pin attachment of the in-line pivoting wheel roller skates with shock absorbers of the present invention.

In FIG. 5, the locking pin 28 is shown in the disengaged and retracted mode. The locking pin 28 is free of the mating hole 24 of the inner boot 12. The locking pin 28 is still retained in the mating hole 26 of the outer boot 14. The smaller stop portion 32 of the mating hole 24 of the outer boot 14 is shown. The locking pin 28 contains a spring loaded retention mechanism 34 comprising retention mechanism springs 44 and 46 that are connected to two spring loaded restrained balls 36 and 38. The balls 36 and 38 fit within channels 40 and 42 of the mating holes 24 and 26 of the inner boot 12 and the outer boot 14. When the locking pin 28 is in the engaged position the ball 36 fits within channel 40 of the mating hole 24 of the outer boot 14 and the ball 38 fits and within channel 42 of the mating hole 26 of the inner boot 12. When the locking pin 28 is in the disengaged and retracted mode, the ball 38 fits within channel 40 of the mating hole 26 of the outer boot 14. The mating hole 26 of the inner boot 12 is empty. The ball 36 is outside the mating hole 24 of the outer boot 14, and rests against the strengthened portion 30 of the outer boot 14.

Figure 6:
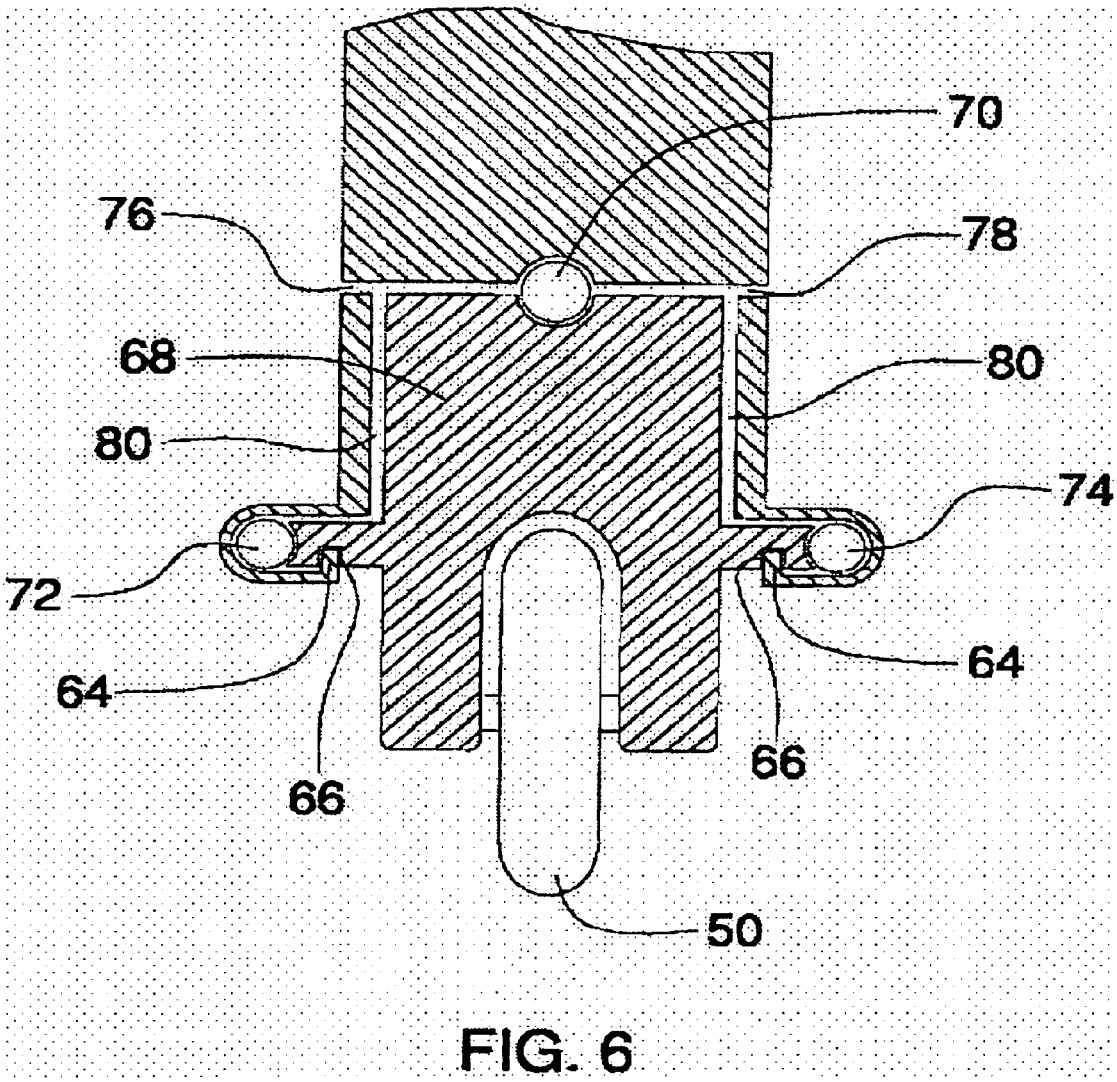
FIG. 6 is a cross-sectional view of another embodiment of the pivoting wheel of the in-line pivoting wheel roller skates with shock absorbers of the present invention.

In FIG. 6, an alternative embodiment of the pivoting wheel frame 60 is shown. The ball bearings 70, 72, and 74 are shown guiding the rotation of the pivoting wheel axle 68. The lubrication addition ports 76 and 78 are shown leading to the lubrication chamber 80. The lubricant added through the lubrication addition ports 76 and 78 and placed into to the lubrication chamber 80 lubricates the ball bearings 70, 72, and 74. The hook 64 slides in the slot 66 of the pivoting wheel axle 68 and functions to retain the pivoting wheel axle 68 and the lubricant in the lubrication chamber 80.

In use, it can now be understood that the in-line pivoting wheel roller skates with shock absorbers are a new and very useful addition to the in-line skater's choice of skates. The locking pin is used to retain and free the inner boot from an outer boot, which allows the boots to pivot at the pivot point. The pivoting causes compression decompression of the springs, which causes the springs to function as shock absorbers. Additionally, the pivoting wheel axle of the pivoting section of the wheel frame rotates on the ball bearings on an axis allowing free wheel pivoting and rotation.

While a preferred embodiment of the in-line pivoting wheel roller skates with shock absorbers has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any size of skate may be manufactured. And although trick skating uses have been described, it should be appreciated that the in-line pivoting wheel roller skates with shock absorbers herein described is also suitable for non-extreme recreational skating.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A truck for an in-line roller skate comprising:

a wheel frame for retention of a plurality of wheels, wherein said wheel frame has a stationary section and a pivoting section connected and stabilized by a brace; said pivoting section contains a pivoting wheel, said wheel pivots along an axis bounded by said pivoting section of said wheel frame; and said wheel frame comprises a hook portion which rotatably engages a slot of a pivoting axle.

2. The truck of claim 1, wherein said pivoting section of said wheel frame contains a plurality of internally lubricated ball bearings.

3. The truck of claim 2, wherein said plurality of ball bearings is composed of a top centered primary ball bearing and horizontally aligned secondary ball bearings.

4. The truck of claim 1, wherein said pivoting section of said wheel frame contains a plurality of horizontally aligned lubrication addition ports.

5. The truck of claim 4, wherein said horizontally aligned lubrication addition ports provide access to a lubrication chamber.

6. The truck of claim 1, wherein said truck is attached to a boot.

7. The truck of claim 1, further comprising a plurality of wheels connected to said wheel frame.

8. The truck of claim 7, wherein said pivoting wheel frame contains a plurality of horizontally aligned lubrication addition ports.

9. The truck of claim 8, wherein said horizontally aligned lubrication addition ports provide access to a lubrication chamber.

* * * * *